US010068512B2

(12) United States Patent
Spevak

(10) Patent No.: US 10,068,512 B2
(45) Date of Patent: Sep. 4, 2018

(54) MODULATOR FOR A MUX LCD

(71) Applicant: Texas Instruments Incorporated, Dallas, TX (US)

(72) Inventor: Peter Spevak, Thonstetten (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 120 days.

(21) Appl. No.: 15/055,229

(22) Filed: Feb. 26, 2016

(65) Prior Publication Data

US 2017/0011675 A1 Jan. 12, 2017

Related U.S. Application Data

(60) Provisional application No. 62/189,429, filed on Jul. 7, 2015, provisional application No. 62/210,208, filed on Aug. 26, 2015.

(51) Int. Cl.

| | |
|---|---|
| ***G09G 3/18*** | (2006.01) |
| ***G09G 3/36*** | (2006.01) |
| ***G09F 9/35*** | (2006.01) |
| ***G09F 9/302*** | (2006.01) |

(52) U.S. Cl.

CPC ..... *G09G 3/18* (2013.01); *G09F 9/3023* (2013.01); *G09F 9/35* (2013.01); *G09G 3/3625* (2013.01); *G09G 2310/06* (2013.01); *G09G 2380/12* (2013.01)

(58) Field of Classification Search

CPC ..... G09G 3/3622; G09G 3/3696; G09G 3/18; G09G 3/3688

See application file for complete search history.

(56) References Cited

U.S. PATENT DOCUMENTS

| | | | | |
|---|---|---|---|---|
| 4,832,454 | A * | 5/1989 | Walters | G09G 3/18 345/38 |
| 5,754,156 | A | 5/1998 | Erhart et al. | |
| 5,977,942 | A | 11/1999 | Walker et al. | |
| 6,008,801 | A | 12/1999 | Jeong | |
| 6,972,881 | B1 | 12/2005 | Bassetti | |
| 7,245,283 | B2 | 7/2007 | Kim et al. | |
| 2003/0052659 | A1 * | 3/2003 | Monomoushi | G05F 1/56 323/284 |
| 2008/0162739 | A1 | 7/2008 | Krah et al. | |
| 2010/0328199 | A1 * | 12/2010 | Piasecki | G09G 3/18 345/98 |
| 2013/0169898 | A1 * | 7/2013 | Hoshino | G09G 3/3622 349/33 |
| 2015/0161927 | A1 | 6/2015 | Hekstra | |

FOREIGN PATENT DOCUMENTS

| | | |
|---|---|---|
| EP | 0546780 | 7/1997 |

* cited by examiner

*Primary Examiner* — Sepehr Azari
(74) *Attorney, Agent, or Firm* — Kenneth Liu; Charles A. Brill; Frank D. Cimino

(57) ABSTRACT

A modulator can include a common signal modulator that outputs a predetermined number of common signals to a multiplexer interface liquid crystal display (MUX LCD) based on an output state of a set of general purpose input/output (GPIO) pins of a controller, wherein each common signal has at least four bias levels. The modulator can also include a segment signal modulator that outputs a predetermined number of segment signals to the MUX LCD based on an output state of another set of GPIO pins of the controller, wherein each segment signal has at least three bias levels.

20 Claims, 13 Drawing Sheets

MODULATOR FOR A MUX LCD

CROSS REFERENCE TO RELATED APPLICATIONS

This application claims the benefit of priority to the U.S. Provisional Patent Application entitled: "EFFECTIVE WAY TO DRIVE ⅓ BIAS 4 MUX LCD USING GPIOS", Application No.: 62/189,429 filed on 7 Jul. 2015, and to the U.S. Provisional Patent Application entitled "EFFECTIVE WAY TO DRIVE ¼ BIAS 8 MUX LCD USING GPIOS", Application No.: 62/210,208 filed on 26 Aug. 2015. The entirety of each of the above-identified applications is incorporated herein by reference.

TECHNICAL FIELD

This disclosure relates to a modulator. More particularly, this disclosure relates to a modulator circuit coupled between a controller and a multiplexer interface liquid crystal display.

BACKGROUND

A liquid-crystal display (LCD) is a flat-panel display or other electronic visual display that employs light-modulating properties of liquid crystals. LCDs are available to display arbitrary images (as in a general-purpose computer display) or fixed images with low information content, which can be displayed or hidden, such as preset words, digits, symbols and 7-segment displays, such as in a digital clock. LCDs are employed in a wide range of applications including computer monitors, televisions, instrument panels, aircraft cockpit displays, and signage. LCDs are also common in consumer devices such as DVD players, gaming devices, clocks, watches, calculators, and telephones.

Some LCDs can be driven with a multiplexing (MUX) interface. Such LCDs can be referred to as MUX LCDs. A MUX LCD employs multiple "backplanes" or segment commons. With this configuration, a given segment control line can be connected to as many segments as there are backplanes, provided that each of the LCD segments tied to the given segment control line is tied to a separate backplane. This technique "multiplexes" each of the segment control lines, which can reduce the number of external connections. This is the method used with complex displays that have limited interconnection surface area or available drive circuits. This reduction in the number of external connections can enhance device reliability and increase the potential display density.

SUMMARY

A modulator is disclosed and described. More particularly, a modulator circuit coupled between a controller and a multiplexer interface liquid crystal display is disclosed and described.

One example relates to a modulator that can include a common signal modulator that outputs a predetermined number of Common signals to a multiplexer interface liquid crystal display (MUX LCD) based on an output state of a set of general purpose input/output (GPIO) pins of a controller, wherein each common signal has at least four bias levels. The modulator can also include a segment signal modulator that outputs a predetermined number of segment signals to the MUX LCD based on an output state of another set of GPIO pins of the controller, wherein each segment signal has at least three bias levels.

Another example relates to a circuit that can include a controller including a set of tristate GPIO pins. The circuit can also include a MUX LCD that outputs messages based on a set of common signals received at a plurality of COM lines and a set of segment signals received at a plurality of segment lines. The circuit can further include a modulator coupled to a set of the GPIO pins of the controller and to the plurality of COM lines and to the plurality of segment lines. The modulator can provide the common signals with at least four bias levels and the modulator provides the segment signals with at least three bias levels.

Yet another example relates to a modulator circuit that includes a given circuit module comprising a given resistive network that provides a set of common signals to a MUX LCD based on an output state of a set of GPIO pins of a controller. Each common signal can have at least four bias levels. The modulator circuit can include another circuit module comprising another resistive network and one of an inverter and a capacitor. The other circuit module can provide a set of segment signals to the MUX LCD based on an output state of another set of GPIO pins of the controller, wherein each segment signal has at least three bias levels.

DETAILED DESCRIPTION

Systems are disclosed for driving a multiplexer interface liquid crystal display (MUX LCD). In one example, a controller (e.g., a microcontroller) can include a plurality of general purpose input/output (GPIO) pins that can be coupled to a modulator (e.g., a circuit). The modulator can be configured to provide common signals (sometimes referred to as COM signals) with at least four bias levels and segment signals with at least three bias levels to the MUX LCD that can each vary based on a state of the GPIO pins.

In this manner, an output displayed by the MUX LCD can be indirectly controlled by the output of the GPIO pins.

The modulator can be formed with relatively simple components, such as resistors, a capacitor and/or an inverter depending on a MUX ratio of the MUX LCD. Moreover, inclusion of the modulator obviates the need for an internal LCD driver at either the MUX LCD or the controller.

Figure 1:
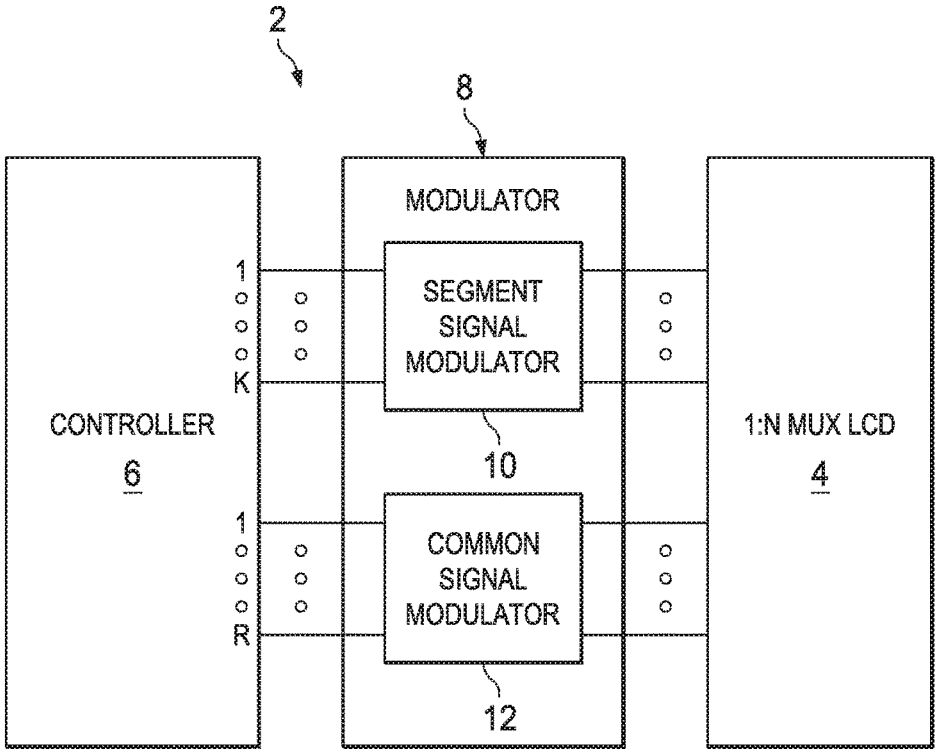
FIG. 1 illustrates a block diagram of a system for driving a MUX LCD.

FIG. 1 illustrates a block diagram of a system 2 for driving a liquid crystal display (LCD) 4 that has a multiplexer (MUX) interface with a 1:N MUX ratio (hereinafter referred to as an "1:N MUX LCD"), where N is greater than 2 (e.g., N is: 3, 4, 7, 8, 11 or 12). The ratio 1:N denotes a number of LCD segments that are tied to each input pin of the 1:N MUX LCD. The 1:N MUX LCD can have any number of segments lines (pins/connectors) and N number of common or backplane (hereinafter, "COM") lines (pins/connectors). The 1:N MUX LCD can have any number of individually controllable segments (e.g., 7 or more).

A controller 6 can provide output signals to a modulator 8 coupled between the controller 6 and the 1:N MUX LCD 4. The controller 6 could be, for example, a microcontroller or any other controller or processor that has general purpose input/output (GPIO) pins that can be controlled by embedded or received instructions. Each GPIO pin can be a tristate GPIO pin that can be in one (1) of three (3) states at any one time, namely a high output state (e.g., a logical '1'), a low output state (e.g., a logical '0') or a high impedance state (e.g., an open circuit state or "off" state).

The modulator 8 can include a segment signal modulator 10 and a common signal modulator 12. The segment signal modulator 10 can output generated segment signals that are coupled to corresponding segment lines of the 1:N MUX LCD 4. The common signal modulator 12 can output generated common signals to corresponding COM lines of the 1:N MUX LCD 4.

The segment signals and the common signals that drive an LCD (including the 1:N MUX LCD 4) are AC (alternating current) in nature to avoid damaging the LCD. For instance, a prolonged DC voltage (e.g., +/−50 millivolts relative to an average ½ $V_{LCD}$, a high voltage of the 1:N MUX LCD 4) initiates an electrochemical process that destroys liquid crystal molecules thereby diminishing the ability of the liquid crystals to twist light polarization. To control the output of the 1:N MUX LCD 4, multiple bias levels (voltages) are applied to the segment signals and the common signals. As used herein, the term "bias level" denotes a relatively constant voltage over a given period of time (e.g., a high or low voltage level in a square wave). The resulting waveforms of the segment signals and the common signals output to the 1:N MUX LCD contain a stair-stepped waveform that maintains specific AC voltages across any given segment/dot to keep the segment in the segment's "visible" ("on") state or "invisible" state (the off state). An LCD Bias number (e.g., ⅓) indicates the number of voltage reference levels that are employed to drive a specific implementation of the 1:N MUX LCD 4. Table 1 characterizes a relationship between a MUX ratio (labeled in Table 1 as "MUX RATIO") of the 1:N MUX LCD 4 and the LCD bias number (labeled in Table 1 as "BIAS NO.", as well as the number of different bias levels (labeled in Table 1 as "BIAS LEVELS") needed to drive the particular configuration.

TABLE 1

| MUX RATIO: | 1:3 | 1:4 | 1:7 | 1:8 | 1:11 | 1:12 |
|---|---|---|---|---|---|---|
| BIAS NO.: | ⅓ | | | | ¼ | |
| BIAS LEVELS: | 4 | | | | 5 | |

For instance, as denoted in Table 1, with an LCD bias number of ⅓, four (4) different bias (voltage) levels are employed to drive a 1:3 or 1:4 MUX LCD. As an example, if the high voltage is $V_{LCD}$ and a low voltage is $V_{SS}$, an LCD bias number of ⅓ employs segment signals and common signals with bias voltage levels of $V_{SS}$, ⅓ $V_{LCD}$, ⅔ $V_{LCD}$ and $V_{LCD}$. As another example, with an LCD bias number of ¼, 5 different bias (voltage) levels are employed to drive a 1:7, 1:8, 1:11 or 1:12 MUX LCD. In this situation, if the high voltage is $V_{LCD}$ and a low voltage is $V_{SS}$, an LCD bias number of ¼ employs segment signals and common signals with bias levels of $V_{SS}$, ¼ $V_{LCD}$, ½ $V_{LCD}$, ¾ $V_{LCD}$ and $V_{LCD}$.

The common signal modulator 12 can be a circuit module that is implemented as a resistive network. The segment signal modulator 10 can be another circuit module that includes a resistive network (that can in some instances include a voltage divider). In addition to the resistive network, in some implementations, the segment signal modulator 10 can include a capacitor or logic component (e.g., an inverter). As an alternative, an additional GPIO pin of the controller 6 can be applied to the signal modulator in place of the logic component. The actual configuration of the common signal modulator 12 and the segment signal modulator 10 is based on the MUX ratio of the 1:N MUX LCD 4 and the number of segments (LCD segments) included in the 1:N MUX LCD 4. Thus, the common signal modulator 12 and the segment signal modulator 10 can be implemented with relatively simple circuit components.

The controller 6 can be connected to the segment signal modulator 10 with K number of tristate GPIO pins on the controller 6, where K is defined by Equation 1. Additionally, the controller 6 can be connected to the common signal modulator 12 with R number of tristate GPIO pins on the controller 6, where R is defined by Equation 2. Accordingly, the total number of GPIO pins needed for the controller 6, G, can be defined by Equation 3. It is noted that in some examples, a particular GPIO pin may be connected to both the segment signal modulator 10 and the common signal modulator 12. Additionally, it is noted that in some examples, more GPIO pins can be used to reduce a number of components in the segment signal modulator 10 (e.g., removal of the inverter).

$$K = \frac{1}{N}(S) + L, \text{ rounding up} \qquad \text{Equation 1}$$

Wherein:

S is the number of segments on the 1:N MUX LCD; and.

L is zero (0) if the segment signal modulator 10 is designed to employ a capacitor or a logic component (e.g., an inverter) and L is one (1) if the segment signal modulator 10 is designed as a resistive network without the capacitor or logic component (e.g., an inverter).

$$R=N+1 \qquad \text{Equation 2}$$

$$G=R+K \qquad \text{Equation 3}$$

It is noted that in one example (hereinafter, "the given example"), the 1:N MUX LCD 4 can have 40 segments. More particularly, in the given example, the 1:N MUX LCD 4 can have a 5 digit numerical display that each have 7 individually controllable segments, and the 1:N MUX LCD 4 can have 5 additional symbols that are individually controllable segments.

The segment signal modulator 10 and the common signal modulator 12 can be configured to modulate the output of the tristate GPIO pins of the controller 6 to form/generate the segment signals and common signals for the 1:N MUX LCD 4. The segment signals from the segment signal modulator 10 and the common signals from the common signal modulator 12 can both have stair-stepped waveforms that can be applied to corresponding inputs (segment lines and COM lines) of the 1:N MUX LCD. The 1:N MUX LCD can output a visual display that is dynamically controlled by the segment signals provided from the segment signal modulator 10 and the common signals provided from the common signal modulator 12. In this manner, the GPIO pins of the controller 6 (that control the output of the segment signal modulator 10 and the common signal modulator 12) can indirectly control the output of the 1:N MUX LCD 4.

Figure 2:
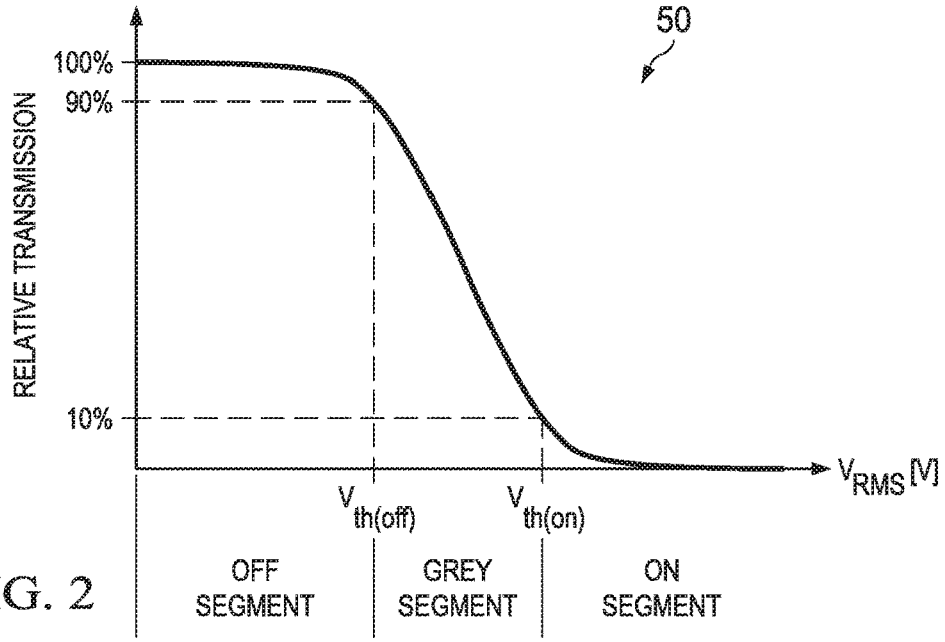
FIG. 2 illustrates a graph that plots an example of relative transmission of an LCD segment as a function of an applied differential root means squared (RMS) voltage.

As noted, in the system 2, the outputs of the modulator 8 (that are controlled by the output of the GPIO pins of the controller 6) can be used to control a visibility of each segment in the 1:N MUX LCD 4. FIG. 2 illustrates a graph 50 that plots a relative transmission of a given LCD segment of the 1:N MUX LCD 4 as a function of a differential root mean squared (RMS) voltage, $V_{RMS}$ between a given segment signal, SEGO and a given common signal, COM0 . As is illustrated in the graph 50, if $V_{RMS}$ between SEG0 and COM0 is above an 'on' (visible) threshold, $V_{th(on)}$ the given segment has a relative transmission of about 10%, such that the given segment is visible (on state). Similarly, if $V_{RMS}$ between SEG0 and COM0 is below an 'off' (visible) threshold, $V_{th(off)}$ the given segment has a relative transmission of about 90%, such that the given segment is invisible (off state). In such a situation, the value of $V_{RMS}$ can be derived from the AC value between SEG0 and the corresponding COM0.

Figure 3:
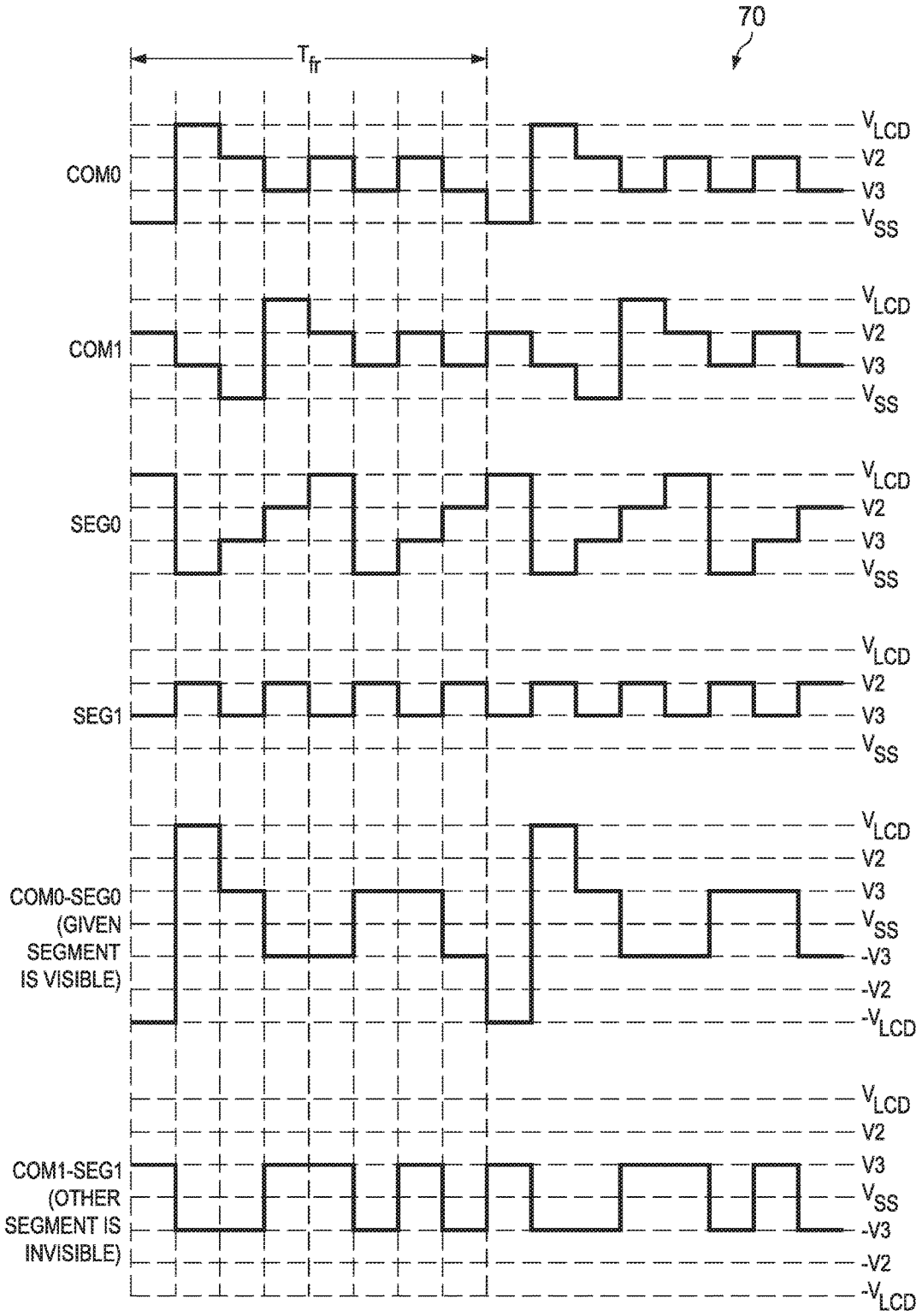
FIG. 3 illustrates a chart of an example of common signals and segment signals for controlling a state of LCD segments.

FIG. 3 illustrates a chart 70 that plots an example output of the given segment signal SEG0 and the given common signal, COM0 , as well as the output of another segment signal, SEG1 and another common signal COM1 over a predetermined LCD frame period of the 1:N MUX LCD 4, labeled in FIG. 3 as "$T_{fr}$". In this example, it is presumed that the given segment of the 1:N MUX LCD 4 is controlled by the peak-to-peak difference between COM0 and SEG0 (labeled in FIG. 3 as "COM0-SEG0 "). Similarly, in this example, it is presumed that the given segment of the 1:N MUX LCD 4 is controlled by the peak-to-peak difference between COM0 and SEG0 (labeled in FIG. 3 as "COM0-SEG0"). The signals SEG0, SEG1 , COM0 and COM1 have stair-stepped waveforms that vary between $V_{LCD}$ and $V_{SS}$. Additionally, the signals SEG0 , SEG1 , COM0 have intermediate bias levels V2 and V3 that are vary based on the MUX ratio of the 1:N MUX LCD 102. For instance, if the MUX ratio is 3 or 4, V2 can be ⅔ $V_{LCD}$ and V3 can be ⅓ $V_{LCD}$. Other MUX ratios (7, 8, 11 or 12), different values of V2 and V3 can be implemented. Additionally, it is noted that for some MUX ratios (e.g., 7, 8, 11 or 12) there can be an additional bias level on the segment signals (5 bias levels).

The signals COM0-SEG0 and COM1-SEG1 have stair-stepped waveforms that vary between $V_{LCD}$ and $-V_{LCD}$ and have intermediate bias levels of V2, V3, $V_{SS}$, −V2 and −V3. As is illustrated in FIG. 3, the superposition of the segment signal (an AC value) and the corresponding common signal (another AC signal) can result in a higher peak-to-peak voltage level, than $V_{LCD}$. Accordingly, when SEG1 is at bias levels of V3 (e.g., ⅓ $V_{LCD}$) and V2 (e.g., ⅔ $V_{LCD}$) the differential RMS voltage between COM1 and SEG1 stays at levels below $V_{th(off)}$. In contrast, when the given segment signal SEG0 and the given common signal COM0 go to full amplitude $V_{SS}$ and $V_{LCD}$ (or vice versa), the differential voltage between SEG0 and COM0 goes to levels above $V_{th(on)}$. Thus, in the chart 70, the given segment controlled by COM0-SEG0 is visible (on state) and the other segment controlled by COM1-SEG1 is invisible (off state).

Referring back to FIG. 1, by employment of the system 2, the need for an embedded LCD driver either at the 1:N MUX LCD 4 or the controller 6 can be avoided. Through a proper arrangement of components in the modulator 8, standard GPIOs of the controller 6 can be employed to control the output of the 1:N MUX LCD. Additionally, as noted, the modulator 8 can apply AC signals to the 1:N MUX LCD 4, thereby avoiding damage caused by prolonged DC voltages.

Figure 4:
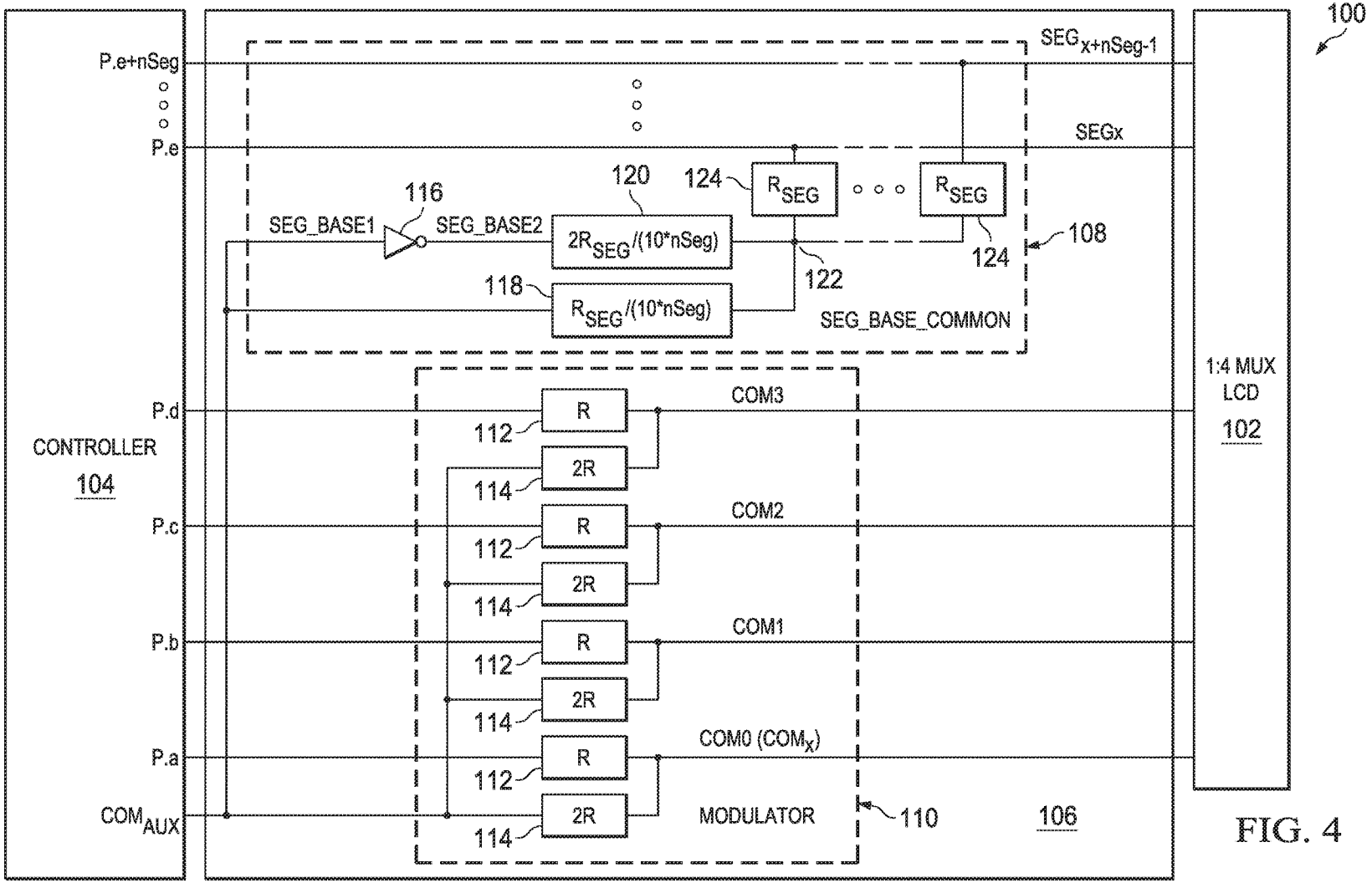
FIG. 4 illustrates a diagram for a modulator that provides a ⅓ biasing scheme for driving a MUX LCD with a MUX ratio of 3-4.

FIG. 4 illustrates another example of a system 100 for driving an LCD that has a 1:4 multiplexer interface, which is referred to as a 1:4 MUX LCD 102. The system 100 can be employed to implement the system 2 illustrated in FIG. 1. For instance, the 1:4 MUX LCD 102 can be employed to implement the 1:N MUX LCD 4 of FIG. 1 (where N=4). Additionally, the system 100 can include a controller 104 that can be employed to implement the controller 6 of FIG. 1. Similarly, the system 100 can include a modulator 106 that can be employed to implement the modulator 8 of FIG. 1.

The modulator 106 can be implemented as discrete circuit components attached to a substrate (e.g., a printed circuit board). Alternatively, the modulator 106 can be implemented as an integrated circuit (IC) chip. The modulator 106 can include a segment signal modulator 108 that can be employed to implement the segment signal modulator 10 of FIG. 1. Additionally, the modulator 106 can include a common signal modulator 110 that can be employed to implement the common signal modulator 12 of FIG. 1. As explained herein, the modulator 106 can be employed to implement a ⅓ biasing scheme that can be applied to the 1:4 MUX LCD 102. Moreover, the modulator 106 can be adapted for employment with a MUX LCD with a different MUX ratio (e.g., 3) that also employs a ⅓ biasing scheme.

In the example illustrated in FIG. 4, the controller 104 has tristate GPIO pins that are coupled to the common signal modulator 110. For the given example, with the 1:4 MUX LCD 102 having 40 individually controllable segments (S), Equations 1-3 (with L being set to zero (0)) indicate that 15 tristate GPIO pins (the total number of GPIO pins, G) of the controller 104 are coupled to the modulator 106. More particularly, in the given example, 10 GPIO pins of the controller 104 can be coupled to the segment signal modulator 108 and 5 GPIO pins can be coupled to the common signal modulator 110, and one of the GPIO pins (namely, a GPIO pin that provides both a $COM_{AUX}$ signal and a signal employed to generate a SEG_BASE_COMMON signal described herein) can be coupled to both the segment signal modulator 108 and the common signal modulator 110.

The common signal modulator 110 can be employed to generate common signals for the 1:4 MUX LCD 102. More particularly, the common signal modulator 110 can output 4 common signals, namely COM0 , COM1 , COM2 and COM3. The 4 common signals can be coupled to corresponding COM lines (input pins) of the 1:4 MUX LCD 102. As illustrated, the common signal modulator 110 can be implemented as a resistive network that includes a plurality of resistors 112 and 114.

The first GPIO pin connected to the common signal modulator 110 can be an auxiliary clock signal (labeled in FIG. 4 and referred to as "$COM_{AUX}$"). The $COM_{AUX}$ pin can have a frequency of about ⅛ of a predetermined LCD frame frequency of the 1:4 MUX LCD 102. Additionally, the second to fifth GPIO pins (labeled in FIG. 4 and describes as pins P.a, P.b., P.c, and P.d) can be connected to the common signal modulator 110. More specifically, the second to fifth GPIO pins of the controller can each be coupled to a resistor 112 with a resistance of 'R', where R can be a resistance of about 10 kilo ohms (kΩ) to about 10 mega ohms (MΩ). Additionally, the $COM_{AUX}$ pin can be coupled to four resistors 114 with a value twice as large as R (2R). The output of each resistor 112 can be coupled to the output of each corresponding resistor 114. Thus, each of the common signals, COM0 , COM1 , COM2 and COM3 can be formed from a combination of two constituent component signals. That is, COMQ is formed from a combination of COMQ_1 (the input of the resistor 112, 'R') and COMQ_2 (the input of resistor 114 '2R'), where 'Q' is the COM number (0 to 3). Moreover, since COM0_2 is the same as COM1_2, COM2_2 and COM3_2, $COM_{AUX}$ (a single GPIO pin) can drive each of the resistors 114 ('2R') to operate as COM0_2, COM1_2, COM2_2 and COM3_2. In a similar manner, the resistors 112 (R) can each be driven by a corresponding GPIO pin (P.a . . . P.d), wherein the signal applied to the resistors 112 (R) is the constituent component COMQ_1.

Figure 5A:
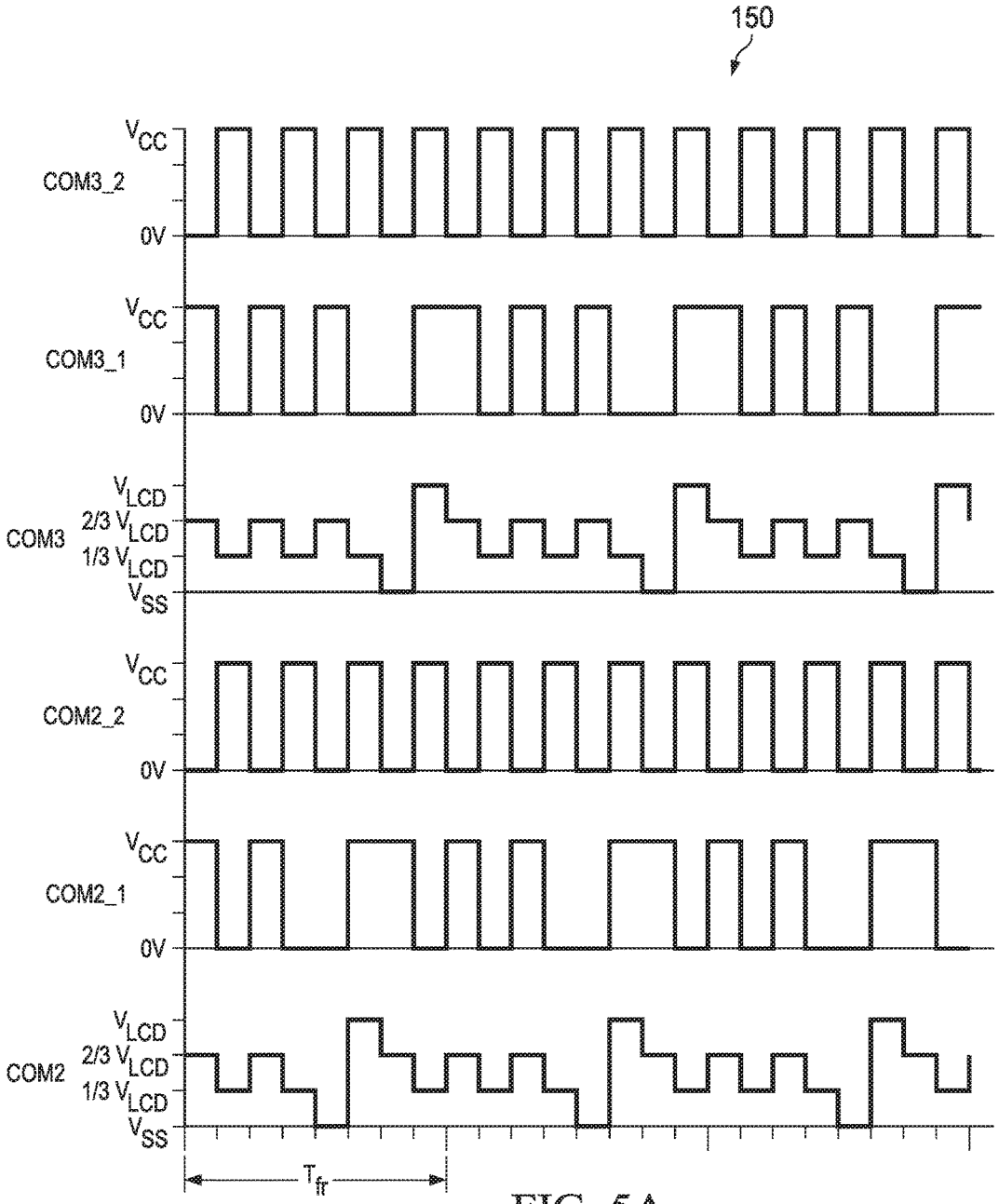
FIGS. 5A and 5B illustrate a chart of example common signals output by the modulator of FIG. 4.
Figure 5B:
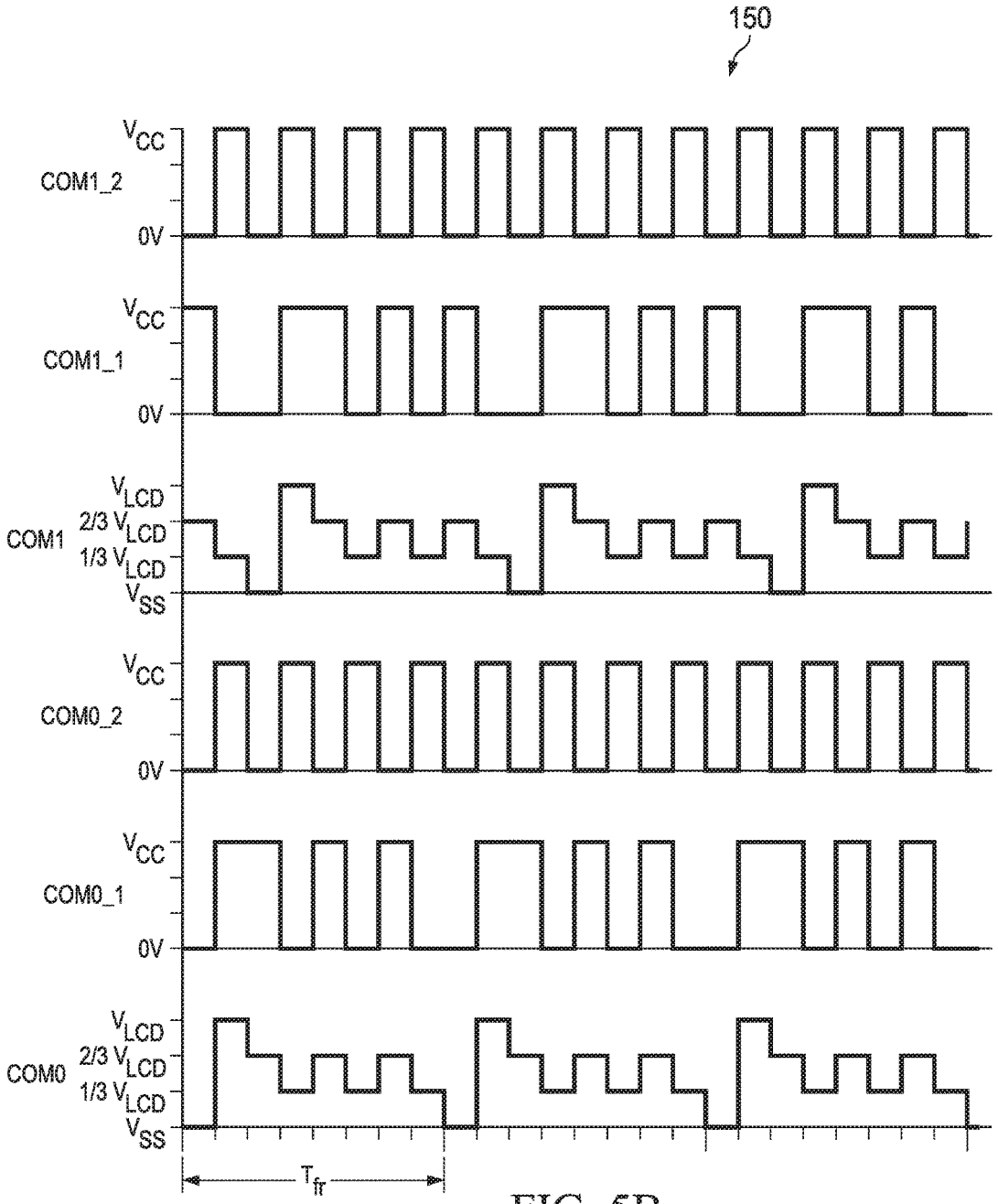

FIGS. 5A and 5B illustrate an example of a chart 150 that plots each common signal, COM0 . . . COM3 as well the constituent components (e.g., COMQ_1 and COMQ_2) output by the common signal modulator 110 of FIG. 4 as a function of time. Additionally, the chart 150 includes a reference notation of a frame period (labeled in FIGS. 5A and 5B as "$T_{fr}$") that the reciprocal of the predetermined LCD frame frequency of the 1:4 MUX LCD. As illustrated by the chart 150, the common signals, COM0 . . . COM3 that are connected to common signal lines (pins) of the 1:4 MUX LCD 102 each have stair-stepped waveforms that vary between bias levels of 0V ($V_{SS}$), ⅓ $V_{LCD}$, ⅔ $V_{LCD}$ and $V_{LCD}$. Conversely, the constituent components (COMQ_1 and COMQ_2) that are driven by GPIO pins on the controller 104 have two states, $V_{SS}$ (0 V) and $V_{cc}$, such that the output of the GPIO pins of the controller 104 can simply be square waves with changing duty cycles. Thus, as illustrated in FIGS. 2 and 3, by using a resistive network of the common signal modulator 110 (resistors 112 (R) and 114 (2R)), the stair-stepped waveforms can be generated from square waves with changing duty cycles.

For instance, as illustrated by the chart 150, for any common signal, COMQ, the first constituent signal COMQ_1 provides an output corresponding to ⅔ $V_{LCD}$ and the second constituent signal COMQ_2 provides an output corresponding to ⅓ $V_{LCD}$. Accordingly, Table 2 identifies the relationship between COMQ and the output of the constituent signals, COMQ_1 and COMQ_2.

TABLE 2

| COMQ | VLCD | ⅔ VLCD | ⅓ VLCD | VSS |
|---|---|---|---|---|
| COMQ_1 | High | High | Low | Low |
| COMQ_2 | High | Low | High | Low |

Referring back to FIG. 4, the segment signal modulator 108 can be employed to generate nSeg number of segment signals (labeled in FIG. 4 as "$SEG_X$ . . . $SEG_{X+nSEG-1}$" (e.g., SEG0 . . . SEG9 in the given example with 10 segment signals), where X is an integer greater than or equal to one. In the given example, where there are 40 segments and 4 common signals (generated from the output of 5 GPIO pins), there are 10 segment signals. Each segment signal ($SEG_X$ . . . $SEG_{X+nSEG-1}$) can be matched with a corresponding common signal.

Continuing with the given example, it is presumed that the segment signal $SEG_X$ is matched with COM0 , which is also referred to as "$COM_X$". Thus, the segment of the 1:4 MUX LCD being controlled by the combination of $SEG_X$ and $COM_X$ is visible (on state) if the differential RMS voltage, $V_{RMS}$ between $SEG_X$ and $COM_X$ is $V_{LCD}$ (or about 90% of $V_{LCD}$) or more. The value of $V_{RMS}$ can be derived from the AC value between $SEG_X$ and the corresponding $COM_M$. As illustrated in FIG. 3, it is noted that the superposition of the segment signal (an AC value) and the corresponding common signal (another AC signal) can result in a higher peak-to-peak voltage level than $V_{LCD}$. Accordingly, when $SEG_X$ or $COM_M$ stays at voltage/bias levels ⅓ $V_{LCD}$ and ⅔ $V_{LCD}$ the differential RMS voltage between $SEG_X$ and $COM_X$ stays at levels below $V_{th(off)}$ (RMS), such that the segment controlled by the combination of $SEG_X$ and $COM_X$ is invisible (off state). Additionally when $SEG_X$ and $COM_M$ go to full amplitude $V_{SS}$ and $V_{LCD}$ (or vice versa), the differential voltage between $SEG_X$ and $COM_M$ goes to levels above $V_{th(on)}$ (RMS) such that the segment controlled by the combination of $SEG_X$ and $COM_X$ is visible (on state).

A specific GPIO pin of the controller 104, labeled in FIG. 4 as P.e can be coupled to a line assigned to $SEG_X$. Similarly, segments P.d (e.g., P.e+1) to P.e+nSeg can be coupled to corresponding lines that are assigned to respective segment signals. Resistors 124 with a resistance of $R_{SEG}$ can be coupled to the lines of P.d to P.e+nSeg. The resistance $R_{SEG}$ can be relatively high (e.g., about 1 MΩ or more).

The $COM_{AUX}$ can be coupled to an input of an inverter 116 and to a resistor 118. The signal driving the input of the inverter 116 can be referred to as SEG_BASE1. The resistor 118 can have a resistance of $R_{SEG}$/(10*nSeg). That is, the resistor 118 can have a resistance that is based on the resistance of the resistors 124 (with a resistance of $R_{SEG}$) and on the number of segment signals (nSeg). More particularly, the resistor 118 can be a resistance that up to 10% the resistance of the resistors 124. Moreover, the output of the inverter 116, which can be referred to as SEG_BASE2 can be coupled to a resistor 120 that can have a resistance of $2R_{SEG}$/(10*nSeg). That is, the resistor 120 can have a resistance that about twice the resistance of the resistor 118.

The resistors 118 $R_{SEG}$/(10*nSeg) and 120 $2R_{SEG}$/(10*nSeg) can be coupled to a common node 122. Additionally, one of the resistors 124 with the resistance of $R_{SEG}$ can be coupled between the common node 122 and the GPIO pin P.e (assigned to $SEG_X$) of the controller 104. In a similar manner, the additional resistors 124 that also have a resistance of $R_{SEG}$ can be coupled to the common node 122 and the respective GPIO pins on the controller 104. It is noted that a signal at the common node 122 can be referred to as SEG_BASE_COMMON.

Figure 6:
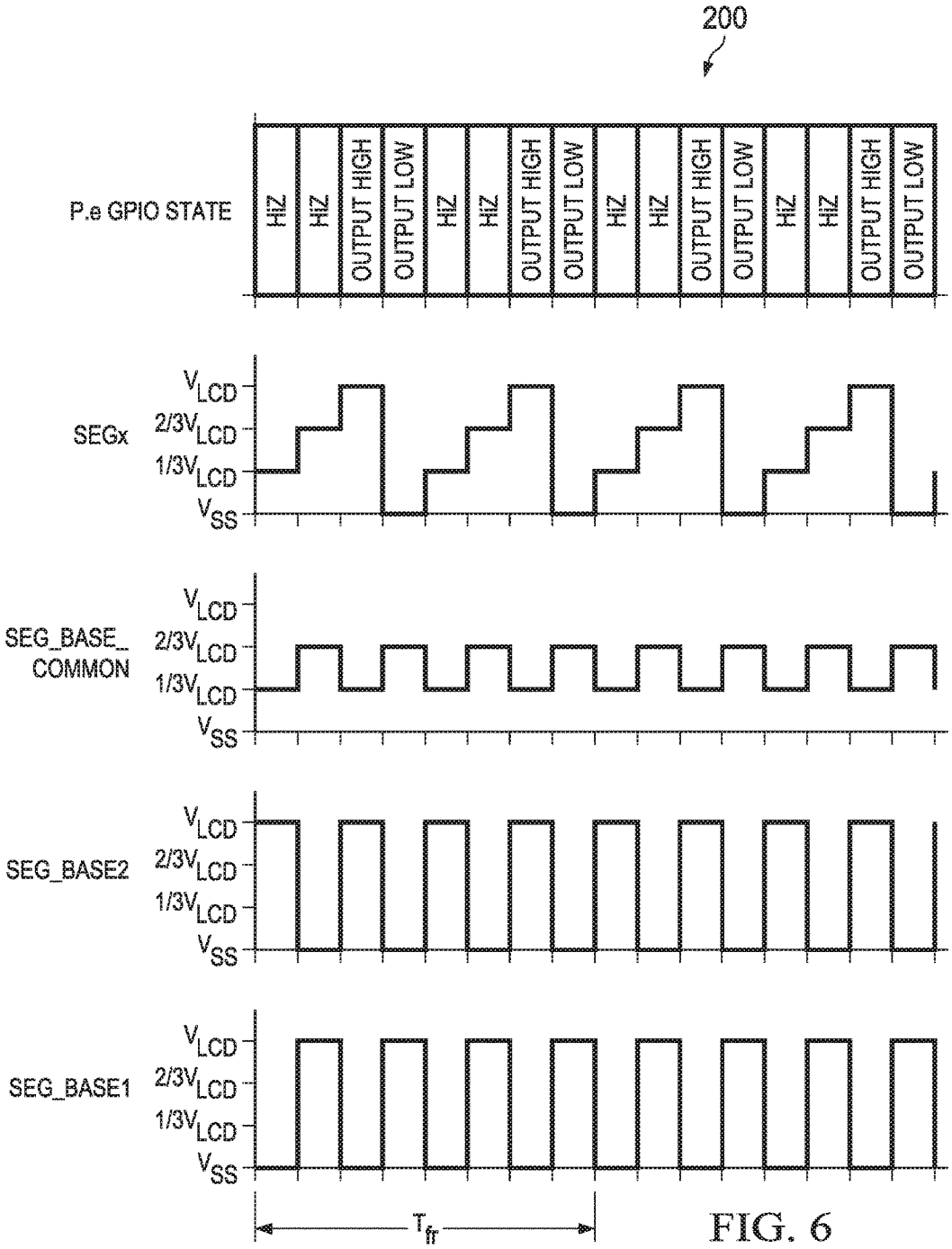
FIG. 6 illustrates a chart that depicts a composition of a segment signal output by the modulator of FIG. 4 that varies based on auxiliary signals and an output state of a general purpose input/output (GPIO) pin.

FIG. 6 illustrates an example of a chart 200 that plots the segment signal $SEG_X$, as well as the SEG_BASE_COMMON, SEG_BASE1 and SEG_BASE2 signals illustrated and described in FIG. 4 as a function of time. The LCD frame period, $T_{rf}$ (the reciprocal of the LCD frame frequency for the 1:4 MUX LCD 102) is labeled to allow for cross referencing of the signal in the chart 200 with the signals in the chart 150 of FIGS. 5A and 5B.

Additionally, a state diagram for the output of the GPIO pin P.e is also included in the chart 200. As noted, the GPIO pins of the controller 104 are tristate GPIO pins. Thus, the GPIO pin P.e can be in a high impedance (e.g., open circuit) state (labeled in FIG. 6 as "HiZ"), a high output state (labeled in FIG. 6 as "Output High") or a low output state (labeled in FIG. 6 as "Output Low").

As illustrated and described with respect to the chart 200, the SEG_BASE_COMMON signal is formed from the two component signals SEG_BASE1 and SEG_BASE2. Additionally, the $SEG_X$ signal varies based on the SEG_BASE_COMMON signal as well as the state of the GPIO pin P.e. In particular, the segment signal, $SEG_X$ follows the SEG_BASE_COMMON signal at time periods where the GPIO pin P.e is in the high impedance state. Moreover, as also illustrated in the chart 200, the segment signal, $SEG_X$ follows the output of the GPIO pin P.e at time periods where the GPIO pin P.e is in either the output high state (an output of $V_{LCD}$) and at time periods where the GPIO pin P.e is at the output low state (an output of $V_{SS}$). As illustrated in the chart 200 (and in the chart 150 of FIGS. 5A and 5B) 4 bias levels, VSS, ⅓ $V_{LCD}$, ⅔ $V_{LCD}$ and $V_{LCD}$ (that implement a ⅓ biasing scheme) are output as the segment signal $SEG_X$ while signals output by the GPIO pins of the controller 104 are simple logic states (e.g., high voltage, low voltage or high impedance).

Referring back to FIG. 4, as noted, the outputs of the segment signal modulator 108 ($SEG_X$ to $SEG_{X+nSEG-1}$) and the outputs of the common signal modulator 110 (COM0 to COM3) can be provided to segment lines (e.g. input pins) of the 1:4 MUX LCD.

Figure 7:
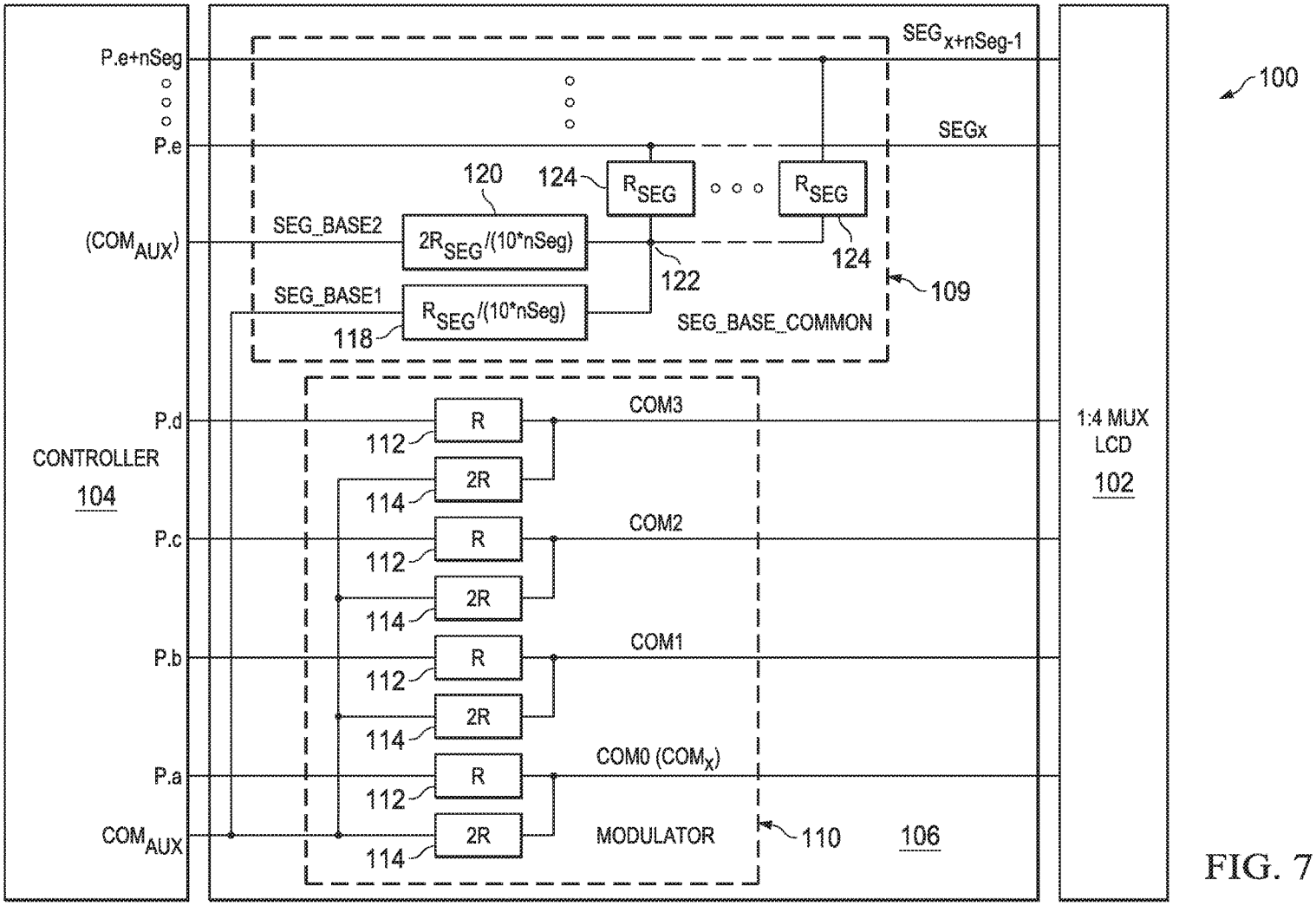
FIG. 7 illustrates an alternative diagram for the modulator illustrated in FIG. 4.

It is noted that in some examples, an additional GPIO pin can be employed. For instance a GPIO that outputs the complement (e.g., an inverted version) of the $COM_{AUX}$ GPIO pin can be employed in place of the inverter 116. FIG. 7 illustrates an alternative segment signal modulator 109 for the system 100. For purposes of simplicity of explanation, the same reference numbers are employed in FIGS. 4 and 7 to denote the same structure. As illustrated in FIG. 7, the controller 104 includes a GPIO pin that outputs the complement (inverse) of $COM_{AUX}$, labeled in FIG. 7 as "($COM_{AUX}$)" " such that in Equations 1-3 L is equal to one (1). As illustrated, the complement of $COM_{AUX}$ is equal to the SEG_BASE2 signal. Accordingly, the segment signal modulator 109 avoids the need for an inverter (e.g., the inverter 116 of FIG. 4) since the pin that outputs ($COM_{AUX}$)" can be coupled to the resistor 120 with the resistance of $2R_{SEG}$/(10*nSeg).

Referring back to FIG. 4, thus, by employment of the system 100 (illustrated in FIGS. 4 and 7), simple circuit components (e.g., an inverter and two simple resistive networks) can be employed to implement the modulator 106. Accordingly, in this manner, the controller 104 can be programmed to change the state of the GPIO pins to control an output of the 1:4 MUX LCD 102. Inclusion of the modulator 106 avoids the need for an internal LCD driver embedded in the controller 104 and/or the 1:4 MUX LCD 102. Additionally, the combination of the segment signals and the common signals avoids an application of a static direct current (DC) voltage on the segments of the 1:4 MUX LCD 102. In fact, as described herein, by employing similar designs, a MUX LCD with a different MUX ratio can also be employed while achieving similar benefits.

For instance, as demonstrated in Table 1, a modulator similar to the modulator 106 can be employed for a 1:3 MUX LCD, since the same number of bias levels (4) can be employed in the same increments (namely, VSS, ⅓ $V_{LCD}$, ⅔ $V_{LCD}$ and $V_{LCD}$). Thus, to modify the modulator 106 to drive a 1:3 MUX LCD, the number of common signals and the number of segments signals can be adjusted accordingly.

Figure 8:
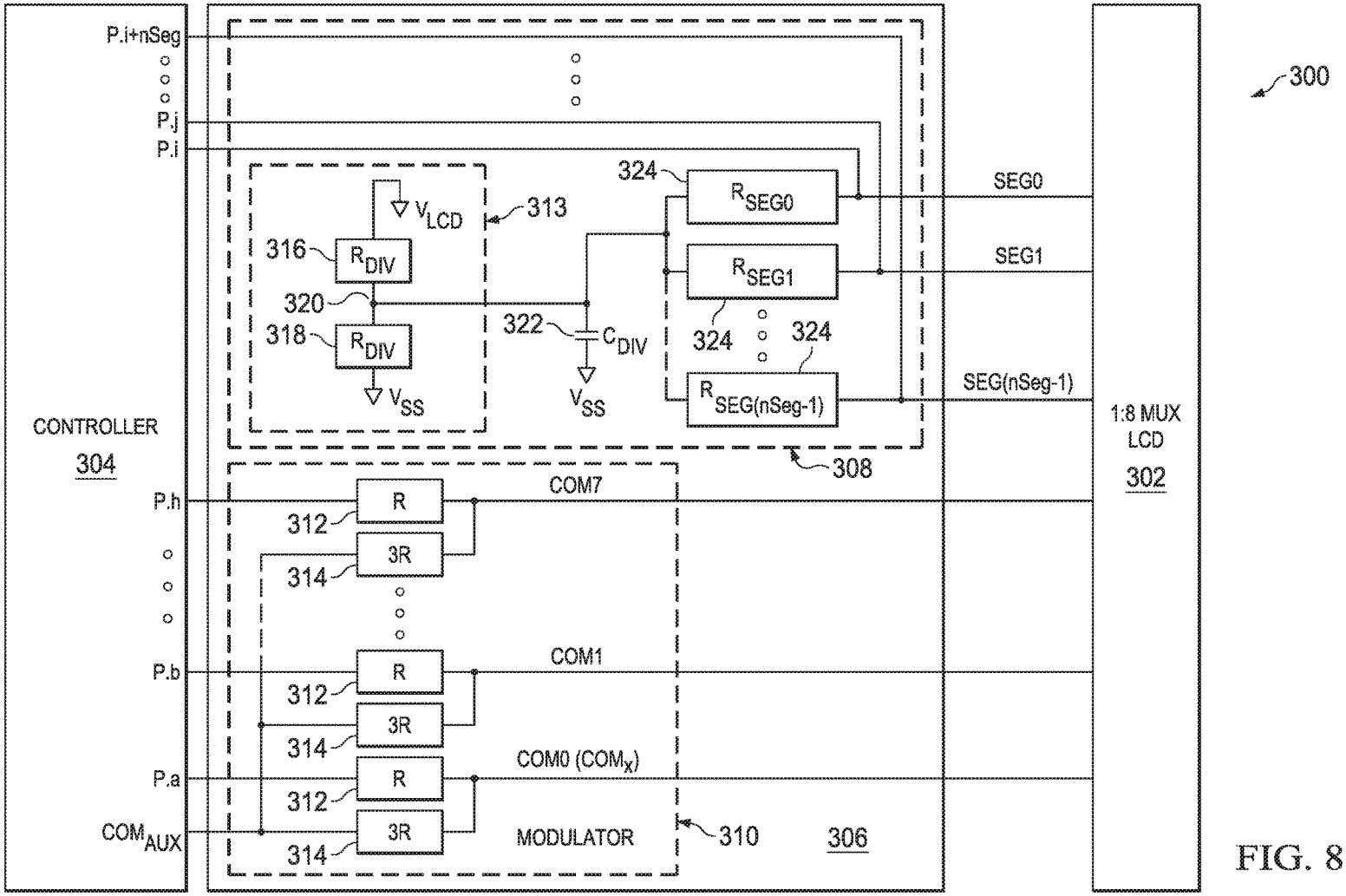
FIG. 8 illustrates a diagram for a modulator that provides a ¼ biasing scheme for driving a MUX LCD with a MUX ratio of 7 to 12.
Figure 9A:
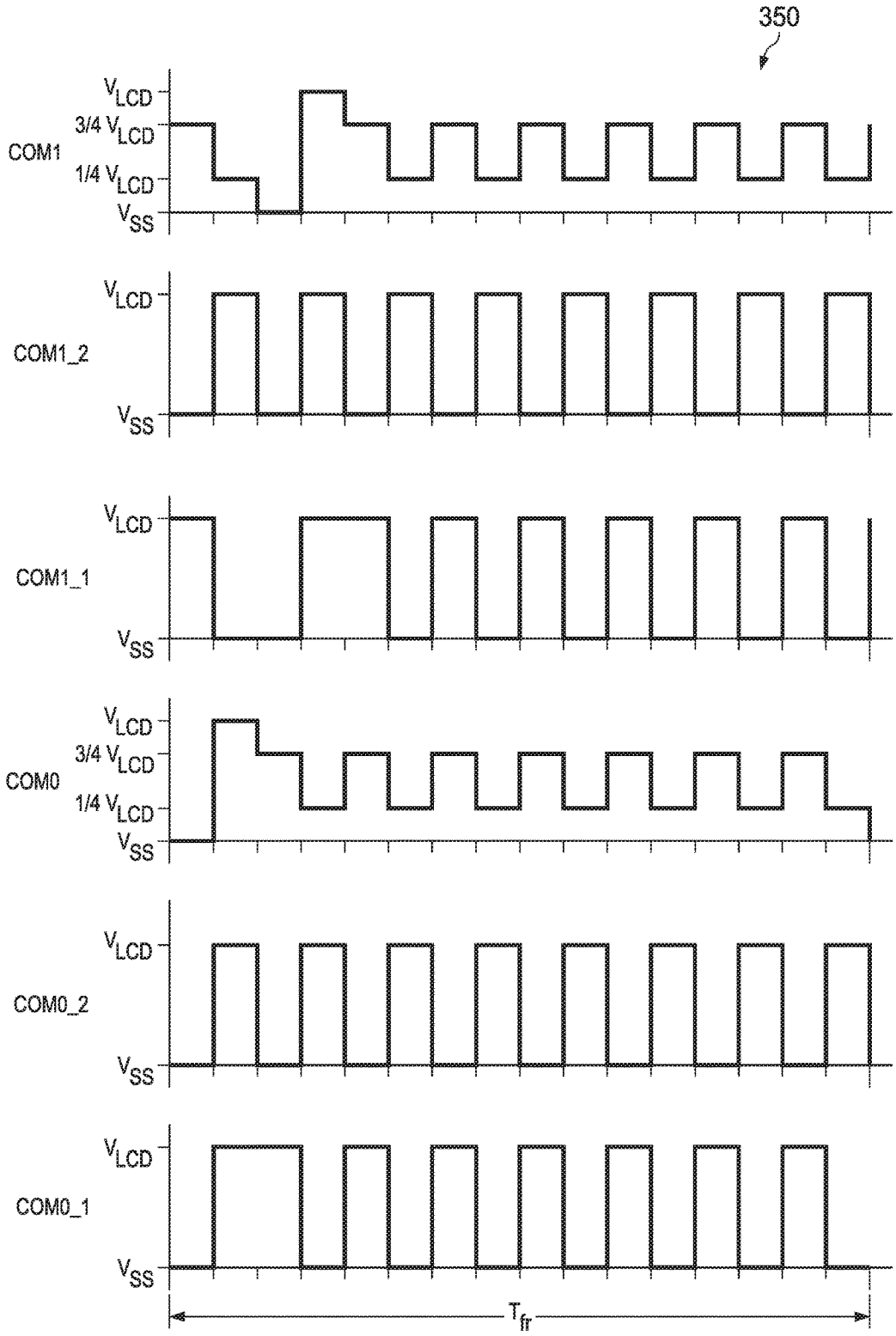
FIGS. 9A-9D illustrate a chart of example common signals output by the modulator of FIG. 8.
Figure 9B:
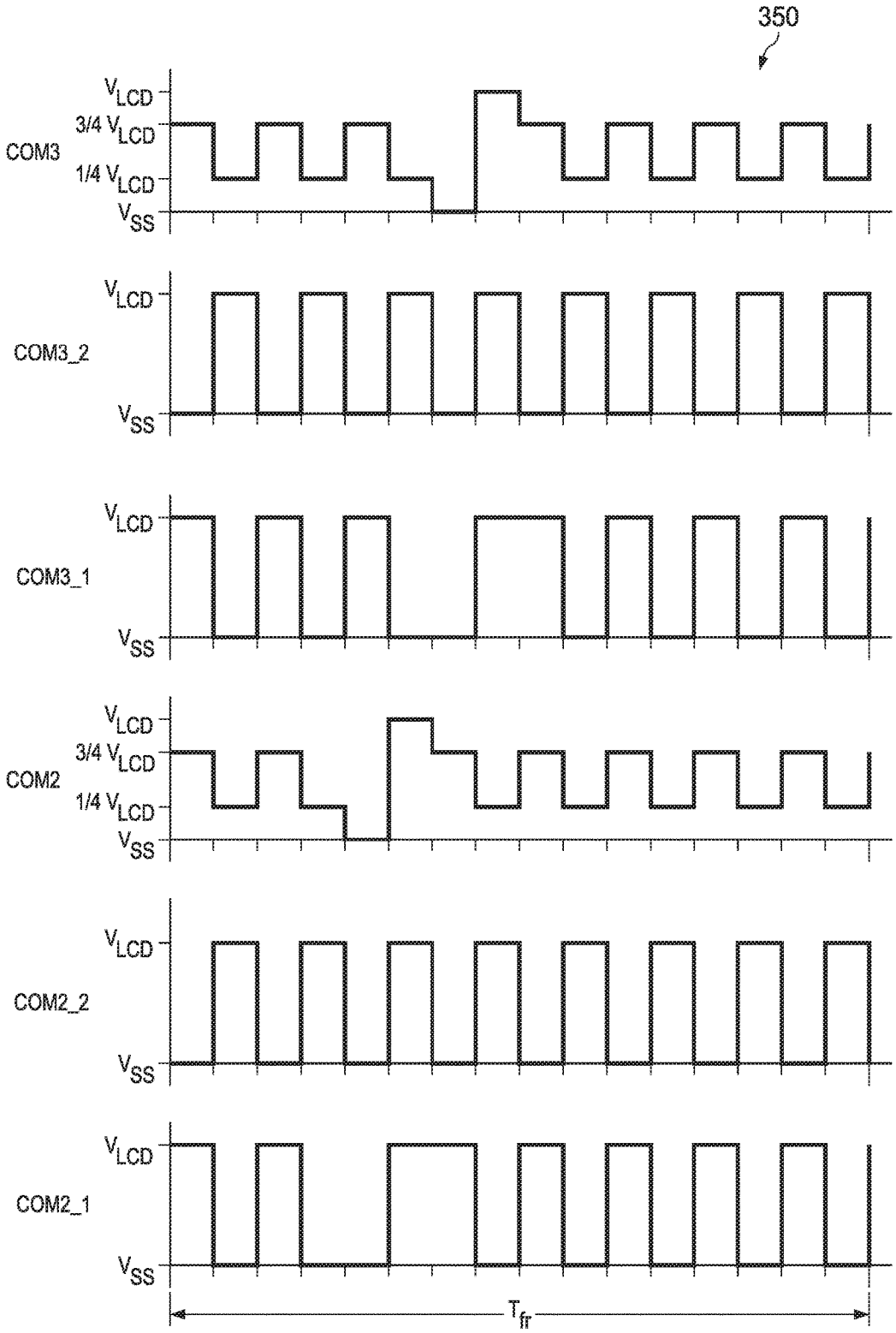
Figure 9C:
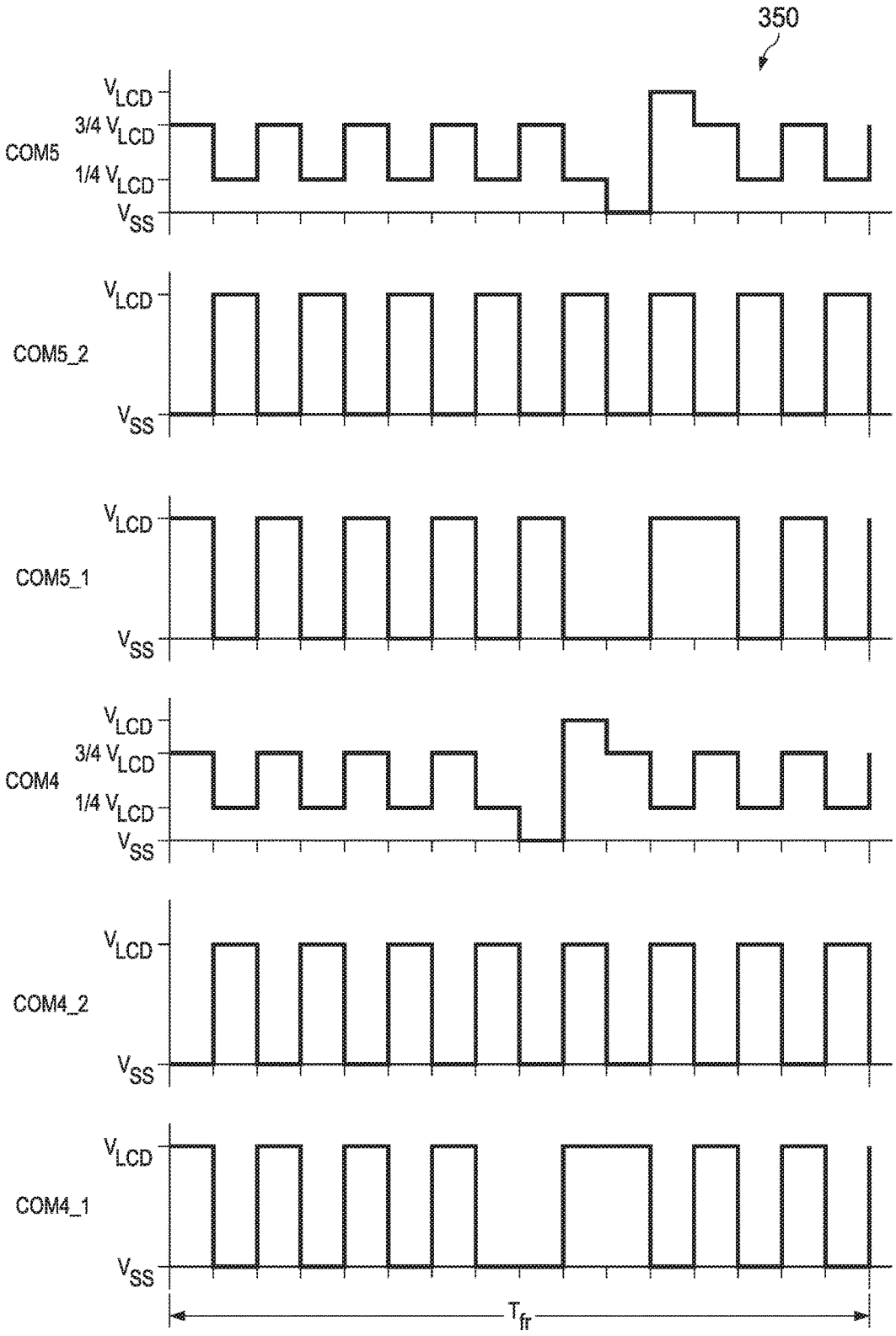
Figure 9D:
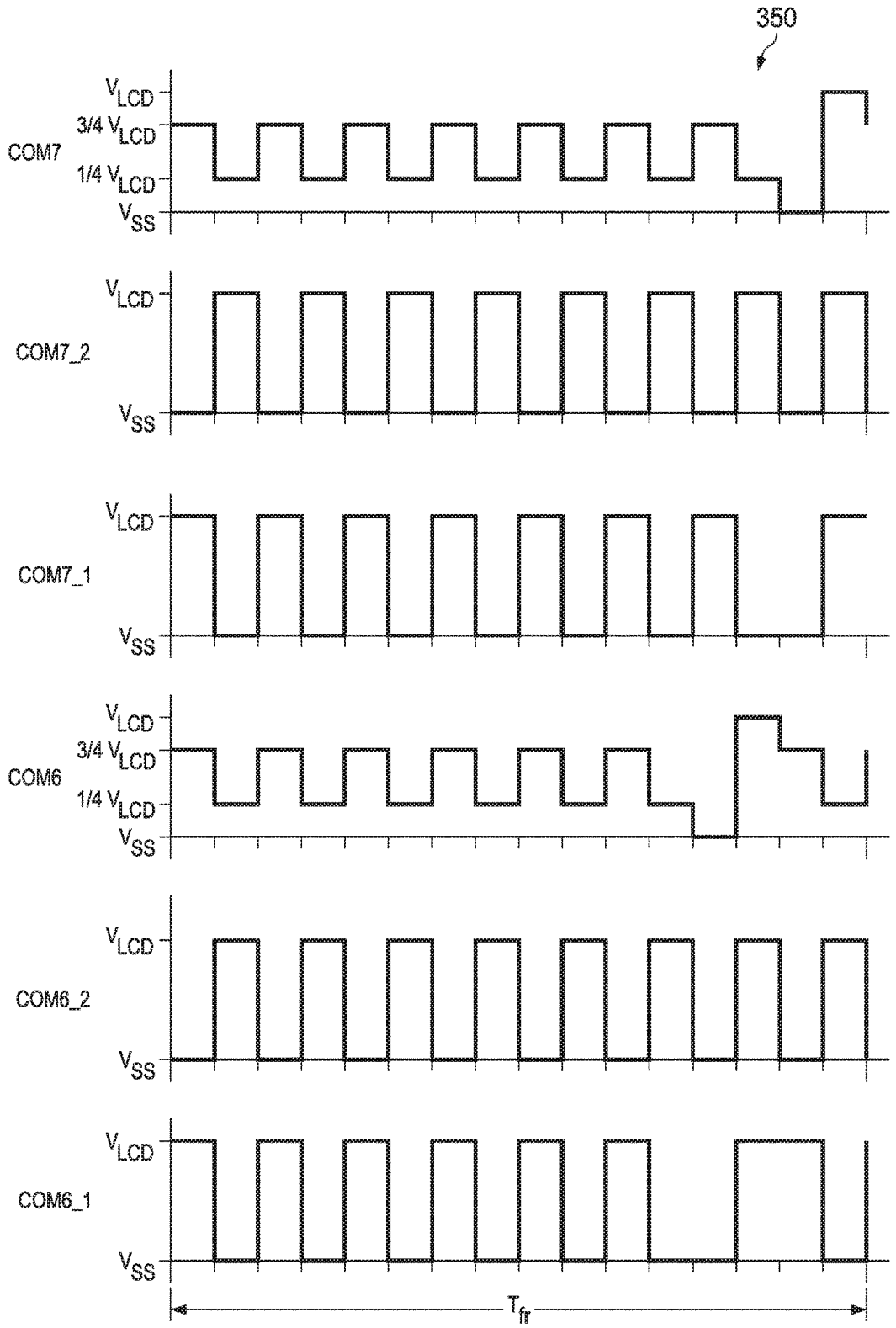

FIG. 8 illustrates another example of a system 300 for driving an LCD that has a 1:8 multiplexer interface, which can be referred to as a 1:8 MUX LCD 302. The system 300 can be employed to implement the system 2 illustrated in FIG. 1. For instance, the 1:8 MUX LCD 302 can be employed to implement the 1:N MUX LCD 4 of FIG. 1. Additionally, the system 300 can include a controller 304 that can be employed to implement the controller 6 of FIG. 1. Similarly, the system 300 can include a modulator 306 that can be employed to implement the modulator 8 of FIG. 1.

The modulator 306 can be implemented as discrete circuit components attached to a substrate (e.g., a printed circuit board). Alternatively or additionally, the modulator 306 can be implemented as an IC chip. The modulator 306 can include a segment signal modulator 308 that can be employed to implement the segment signal modulator 10 of FIG. 1. Additionally, the modulator 306 can include a common signal modulator 310 that can be employed to implement the common signal modulator 12 of FIG. 1. As explained herein, the modulator 306 can be employed to implement a ¼ biasing scheme that can be applied to the 1:8 MUX LCD 302. Moreover, the modulator 306 can be adapted for employment with a MUX LCD with a different MUX ratio (e.g., 7, 11 or 12) that also employs a ¼ biasing scheme.

In the example illustrated in FIG. 8, the controller 304 has GPIO pins that are coupled to the modulator 306. For the given example, with the 1:8 MUX LCD 302 having 40 individually controllable segments, Equations 1-3 (with L being set to zero (0)) note that 14 GPIO pins of the controller 304 are coupled to the modulator 106. More particularly, in the given example, 5 GPIO pins of the controller 104 can be coupled to the segment signal modulator 308 and 9 GPIO pins can be coupled to the common signal modulator 110.

The common signal modulator 310 can be employed to generate common signals for the 1:8 MUX LCD 302. More particularly, the common signal modulator 310 can output 8 common signals, namely COM0 , COM1 , COM2, COM3, COM4, COM5, COM6 and COM7. The 8 common signals can be coupled to corresponding COM lines (input pins) of the 1:8 MUX LCD 302. As illustrated, the common signal modulator 310 can be implemented as a resistive network.

In the given example, the first pin connected to the common signal modulator 310 can be an auxiliary clock signal (labeled in FIG. 8 and referred to as "$COM_{AUX}$"). The $COM_{AUX}$ can have a frequency of about 1/16 of a predetermined LCD frame frequency of the 1:8 MUX LCD 302. Additionally, the second to ninth GPIO pins (labeled in FIG. 8 and describes as pins P.a, P.b . . . P.h) can be connected to the common signal modulator 310. More specifically, in the given example, the second to GPIO pins of the controller 304 can each be coupled to a resistor 312 with a resistance of 'R', where R can be a resistance of about 10 kilo ohms (kΩ) to about 10 mega ohms (MΩ). Additionally, the $COM_{AUX}$ pin can be coupled to eight resistors 314 with a value of 3R (three times as large as R). The output of each resistor 312 can be coupled to the output of each corresponding resistor 314. Thus, each of the common signals, COM0 . . . COM7 can be formed from a combination of two constituent component signals. That is, COMQ corresponds to a combination of COMQ_1 (the input of the resistor 312, R) and COMQ_2 (the input of resistor 314 3R), where 'Q' is the COM number (0 to 7). Moreover, since COM0_2 is the same as COM1_2, COM2_2, COM3_2, COM4_2, COM5_2, COM6_2 and COM7_2, $COM_{AUX}$ (a single GPIO pin) can drive each of the resistors 314 (3R) to operate as COM0_2, COM1_2, COM2_2, COM3_2, COM4_2, COM5_2, COM6_2 and COM7_2. Additionally, in some examples, a mirror of $COM_{AUX}$ may be included increase the current through the resistors 314. The resistors 312 (R) can each be driven by a corresponding GPIO pin (P.a . . . P.h), wherein the signal applied to the resistors 312 (R) is the constituent component COMQ_1.

FIGS. 9A-9D illustrate an example of a chart 350 that plots each common signal, COM0 . . . COM7 output by the common signal modulator 310 of FIG. 8 as well the constituent components (e.g., COMQ_1 and COMQ_2) as a function of time. Additionally, the chart 350 includes a reference notation of a frame period (labeled in FIGS. 9A-9D as "$T_{fr}$") that is the reciprocal of the predetermined LCD frame frequency of the 1:8 MUX LCD. As illustrated by the chart 350 the common signals, COM0 . . . COM7 that are connected to common signal lines (input pins) of the 1:8 MUX LCD 302 each have stair-stepped waveforms that vary between bias levels of 0V ($V_{SS}$), ¼ $V_{LCD}$, ½ $V_{LCD}$, ¾ $V_{LCD}$ and $V_{LCD}$. Conversely, the constituent components (COMQ_1 and COMQ_2) that are driven by GPIO pins on the controller 104 have two states, 0V ($V_{SS}$) and $V_{LCD}$, such that the output of the GPIO pins of the controller 104 can simply be square waves with changing duty cycles. Thus, as illustrated in FIGS. 5A, 5B and 6, by using a resistive network (resistors 312 (R) and 314 (3R)), the stair-stepped waveforms can be generated from square waves with changing duty cycles.

For instance, as illustrated by the chart 350, for any common signal, COMQ, the first constituent signal COMQ_1 provides an output corresponding to ¾ $V_{LCD}$ and the second constituent signal COMQ_2 provides an output corresponding to ¼ $V_{LCD}$. Accordingly, Table 3 identifies the relationship between COMQ and the output of the constituent signals, COMQ_1 and COMQ_2.

TABLE 3

| COMQ | VLCD | ¾ VLCD | ¼ VLCD | VSS |
|---|---|---|---|---|
| COMQ_1 | High | High | Low | Low |
| COMQ_2 | High | Low | High | Low |

Referring back to FIG. 8, the segment signal modulator 308 can be employed to generate nSeg number of segment signals (labeled in FIG. 8 as "SEG0 . . . SEG(nSeg−1)". In the given example, where there are 40 segments and 9 common signals, there are 5 segment signals, such that there could be SEG0 . . . SEG4. Each segment signal (SEG0 . . . SEG(nSeg−1)) in the given example with 5 segment signals) can be matched with a corresponding common signal.

Continuing with the given example, it is presumed that the segment signal SEG0 is matched with COM0 . Thus, the segment being controlled by the combination of SEG0 and COM0 is visible (on state) if the differential RMS voltage between SEG0 and COM0 is $V_{LCD}$ (or about 90% of $V_{LCD}$) or more. The value of $V_{RMS}$ can be derived from the AC value between SEG0 and the corresponding COM0 . As illustrated and explained with respect to FIG. 3, it is noted that the superposition of the segment signal (an AC value) and the corresponding common signal (another AC signal) can result in a higher peak-to-peak voltage level, than $V_{LCD}$. Accordingly, when SEG0 stays at bias (voltage) levels ½ $V_{LCD}$, or COM0 stays at the bias voltage levels of ¼ $V_{LCD}$ or ¾ $V_{LCD}$ the differential RMS voltage between SEG0 and COM0 stays at levels below $V_{th(off)}$ (RMS), such that the segment controlled by the combination of SEG0 and COM0 is invisible (off state). Additionally, when SEG0 and COM0 go to full amplitude $V_{SS}$ and $V_{LCD}$ (or vice versa), the differential voltage between SEG0 and COM0 goes to levels above $V_{th(on)}$ (RMS) such that the segment controlled by the combination of SEG0 and COM0 is visible (on state).

A specific GPIO pin of the controller 304, labeled in FIG. 8 as P.i can be coupled to a line assigned to SEG0 . Similarly, segments P.j (e.g., P.i+1) to P.j+nSeg can be coupled to corresponding lines that are assigned to respective segment signals.

A (resistive) voltage divider 313 can be provided between a voltage, $V_{LCD}$ and $V_{SS}$. Moreover, the resistive voltage divider 313 can be formed with two resistors, namely resistor 316 with a resistance of $R_{DIV}$ and another resistor 318 with a same resistance of $R_{DIV}$. A node of the resistor 316 can be coupled to the voltage $V_{LCD}$ and a node of the resistor 318 can be coupled to the voltage $V_{SS}$. Additionally, the resistor 316 and the resistor 318 can be coupled together at a voltage dividing node 320 (e.g., an output of the voltage divider 313). A capacitor 322, with a capacitance of $C_{DIV}$ can also be coupled to the voltage dividing node 320 and to the voltage $V_{SS}$.

$R_{DIV}$ can be selected such that the voltage dividing node 320 can have a voltage of about ½ $V_{LCD}$ and a relatively small current. Thus, the resistance $R_{DIV}$ of the resistors 316 and 318 can be within a range of about 1 MΩ to 100 MΩ. Additionally, the capacitance, $C_{DIV}$ of the capacitor 322 can be selected to provide a full charge for at least 1/16 of the LCD frame period of the 1:8 MUX LCD. For instance, the capacitance, $C_{DIV}$ of the capacitor 322 can be selected to be at least about 10 pico-Farads (pF) per segment of the 1:8 MUX LCD 302.

The voltage dividing node 320 can also be coupled to nSeg number of segment resistors 324, $R_{SEG0}$. . . $R_{SEG(nSeg-1)}$. Each of the segment resistors 324 can also be coupled to the corresponding LCD segment in the 1:8 MUX LCD 302. Each segment resistor 324 can be selected based on a total size of the corresponding LCD segment being driven. For instance, in a standard 7 segment digit, each segment resistor 324 could have a resistance of about 1 MΩ. Additionally, segments resistors 324 that are coupled to segments larger than the digit segments on the 1:8 MUX LCD 302 (e.g., a battery level indicator) may have a lower resistance (e.g., about 500 kΩ) to ensure sufficient current provided to the corresponding LCD segment of the 1:8 MUX LCD 302.

Figure 10:
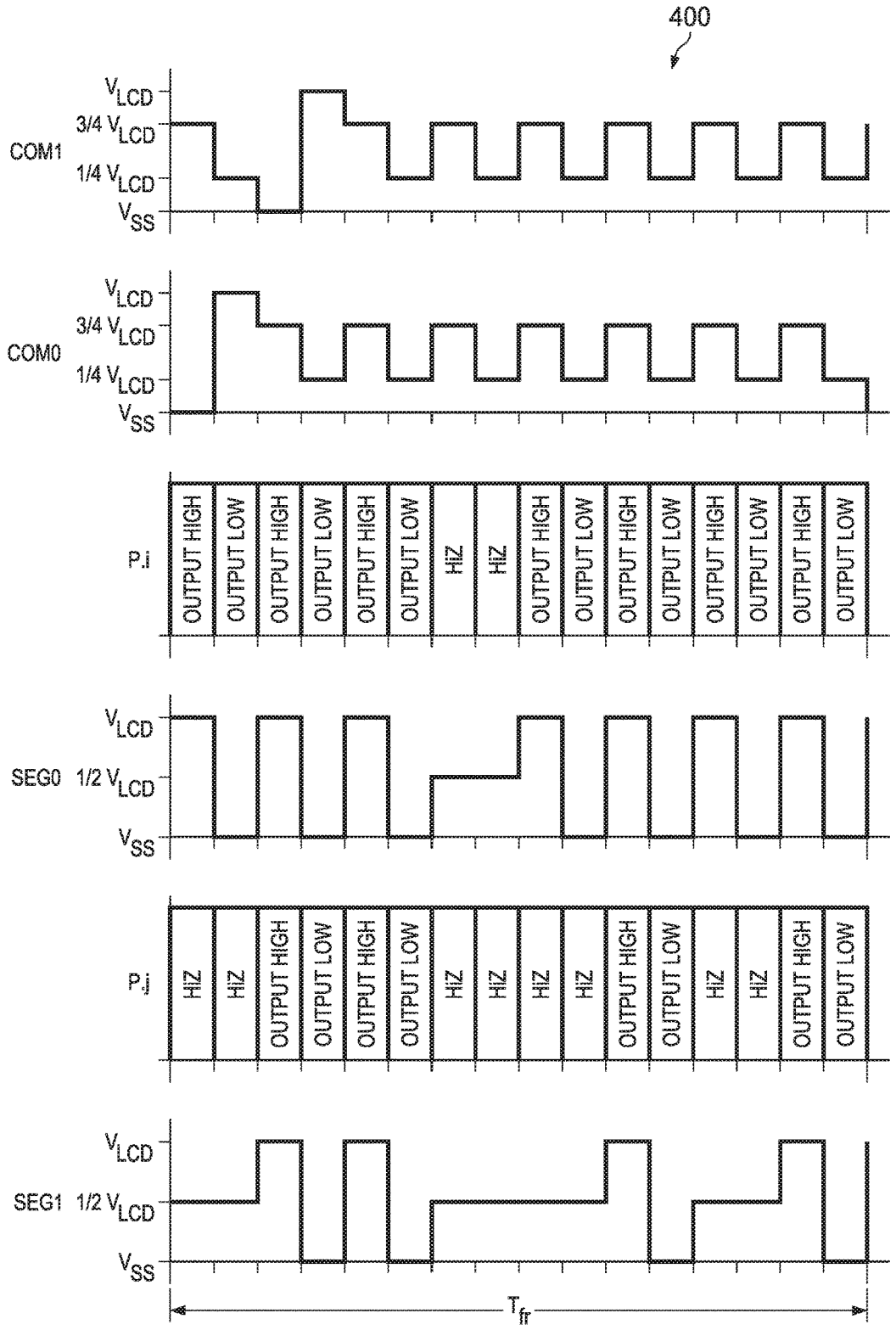
FIG. 10 illustrates a chart of example that depicts segment signals output by the segment modulator of FIG. 8 that vary based on an output state of GPIO pins.

FIG. 10 illustrates an example of a chart 400 that plots the segment signals SEG0 and SEG1 as well as the corresponding common signals, COM0 and COM 1 signals illustrated and described in FIGS. 9A-9D as a function of time. The LCD frame period, $T_{rf}$ (the reciprocal of the LCD frame frequency for the 1:8 MUX LCD 102) is labeled to allow for cross referencing of the signal in the charts 400 with the signals in the chart 350 of FIGS. 9A-9D.

Additionally, a state diagram for the output of the GPIO pins P.i and P.j are also included in the chart 200. As noted, the GPIO pins of the controller 104 are tristate GPIO pins. Thus, the GPIO pins P.i and P.j can be in a high impedance (e.g., open circuit) state (labeled in FIG. 10 as "HiZ"), a high output state (labeled in FIG. 10 as "Output High") or a low output state (labeled in FIG. 10 as "Output Low").

As illustrated in the plot 400, the segment signal, SEG0 follows the output of the tristate GPIO pin P.i at time periods where the GPIO pin P.i is in the output high state or the output low state. Similarly, SEG1 follows the output of the tristate GPIO pin P.j at time periods where the GPIO pin P.j is in the output high state or the output low state. Furthermore, as illustrated in the plot 400, at time periods where the GPIO pin P.i is in the high impedance state, SEG0 follows the voltage of the voltage dividing node 320 (½ $V_{LCD}$). Similarly, at time periods where the GPIO pin P.j is in the high impedance state, SEG1 also follows the voltage of the voltage dividing node 320 (½ $V_{LCD}$). As illustrated in the plot 400 (and in the chart 350 of FIGS. 9A-9D) five (5) bias levels, VSS, ¼ $V_{LCD}$, ½ $V_{LCD}$, ¾ $V_{LCD}$ and $V_{LCD}$ (for a ¼ biasing scheme) are provided, while signals output by the GPIO pins of the controller 304 are simple logic states (e.g., high, low or high impedance).

Referring back to FIG. 8, as noted the outputs of the segment signal modulator 308 (SEG0 to SEG(nSEG−1)) can be provided to segment lines (e.g., input pins of the 1:8 MUX LCD 302. Similarly the outputs of the common signal modulator 310 (COM0 to COM7) can be provided to COM line (e.g. pins) of the 1:8 MUX LCD 302. Accordingly, a visibility state of each segment in the 1:8 MUX LCD 302 can be indirectly controlled by standard tristate GPIO pins of the controller 304. Additionally, the combination of the segment signals and the common signals avoids an application of a static (DC) voltage on the segments of the 1:8 MUX LCD 302.

Thus, by employment of the system 300, simple circuit components (e.g., a capacitor and two resistive networks) can be employed to implement the modulator 106. Accordingly, in this manner, the controller 304 can be programmed to change the state of the GPIO pins to indirectly control an output of the 1:8 MUX LCD 302. Inclusion of the modulator 306 avoids the need for an internal LCD driver embedded in the controller 304 and/or the 1:8 MUX LCD 302.

Furthermore, as demonstrated in Table 1, a modulator similar to the modulator 306 can be employed for a 1:7, 1:11 or a 1:12 MUX LCD, since the same number of bias levels (5) are needed in the same increments (namely, VSS, ¼ $V_{LCD}$, ½ $V_{LCD}$, ¾ $V_{LCD}$ and $V_{LCD}$). For instance, common signals and/or segment signals can be added or removed from the modulator 306 to account for a change in a MUX ratio of the MUX LCD.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A modulator comprising:

a common signal modulator that outputs a predetermined number of common signals to a multiplexer interface liquid crystal display (MUX LCD) in response to a first set of control signals provided by a first set of general purpose input/output (GPIO) pins of a controller and received by the common signal modulator, wherein each common signal has at least four bias levels; and a segment signal modulator that outputs a predetermined number of segment signals to the MUX LCD in response to a second set of control signals provided by a second set of GPIO pins of the controller and received by the segment signal modulator, wherein each segment signal has at least three bias levels;

wherein the first set of control signals includes an auxiliary clock signal that is also one of the second set of control signals, the common signal modulator and the segment signal modulator are each coupled to a first GPIO pin that provides the auxiliary clock signal, and the first GPIO pin is one of the first set of GPIO pins and one of the second set of GPIO pins.

2. The modulator of claim 1, wherein each GPIO pin of the controller coupled to the segment signal modulator switches between a high voltage output, a low voltage output and a high impedance state.

3. The modulator of claim 2, wherein each GPIO pin of the controller coupled to the common signal modulator switches between the high voltage output and the low voltage output.

4. The modulator of claim 1, wherein the common signal modulator comprises a resistive network.

5. The modulator of claim 1, wherein the segment signal modulator comprises a resistive network and an inverter.

6. The modulator of claim 1, wherein the segment signal modulator comprises a resistive network that includes a voltage divider.

7. The modulator of claim 6, wherein the segment signal modulator further comprises a capacitor coupled to an output of the voltage divider.

8. The modulator of claim 1, wherein the common signals and the segment signals are alternating current (AC) signals.

9. The modulator of claim 1, wherein the common signal modulator is coupled to N+1 number of GPIO pins of the controller, where N is a number of common signals output to the MUX LCD by the common signal modulator.

10. The modulator of claim 9, wherein the segment signal modulator is coupled to (1/N)*S number or (1/N)*S+1 number of GPIO pins of the controller, where S is a number of LCD segments in the MUX LCD.

11. The modulator of claim 1, wherein the MUX LCD has a MUX ratio of 1:3 or 1:4.

12. The modulator of claim 11, wherein the segment signals have four bias levels.

13. The modulator of claim 1, wherein the MUX LCD has a MUX ratio of 1:7, 1:8, 1:11 or 1:12.

14. The modulator of claim 13, wherein the segment signals have three bias levels, wherein a given bias level of the segment signals is different from each of the bias levels of the common signals.

15. A circuit comprising:

a controller comprising a set of tristate general purpose input/output (GPIO) pins;

a multiplexer interface liquid crystal display (MUX LCD) that outputs messages based on a set of common (COM) signals received at a plurality of COM lines and a set of segment signals received at a plurality of segment lines; and a modulator coupled to a set of the GPIO pins of the controller and to the plurality of COM lines and to the plurality of segment lines, wherein the modulator includes a common signal modulator circuit to provide the common signals with at least four bias levels responsive to signals provided by a first subset of the set of GPIO pins and a segment signal modulator circuit to provide the segment signals with at least three bias levels responsive to a second subset of the set of GPIO pins;

wherein the set of GPIO pins includes a first GPIO pin to supply an auxiliary clock signal and the first GPIO pin is part of the first and second subsets.

16. The circuit of claim 15, wherein the modulator provides the common signals with four bias levels.

17. The circuit of claim 16, wherein the modulator provides the common signals with four bias levels and the modulator provides the segment signals with three bias levels, wherein a given bias level of the segment signals is different from each of the bias levels of the common signals.

18. A modulator circuit comprising:

a first circuit module comprising a first resistive network that provides a set of common signals to a multiplexer interface liquid crystal display (MUX) LCD based on an output state of a set of general purpose input/output (GPIO) pins, wherein each common signal of the first resistive network is coupled to a corresponding set of resistors of different resistances, wherein a first resistor in each set of resistors is coupled to a particular GPIO pin of the controller and a second resistor in each set of resistors is coupled to a clock signal output by a GPIO pin of the controller; and a second circuit module comprising a second resistive network and one of an inverter and a capacitor, the second circuit module providing a set of segment signals to the MUX LCD based on an output state of another set of GPIO pins of the controller.

19. The modulator circuit of claim 18, wherein the common signals have at least four bias levels.

20. The modulator circuit of claim 18, wherein the segment signals have at least three bias levels.

* * * * *